United States Patent [19]

Stemmler

[11] Patent Number: 4,709,606

[45] Date of Patent: Dec. 1, 1987

[54] PLANT FOR PRODUCING STACKS OF INTERMESHED BLANKS OF PAPER, CELLULOSE OR THE LIKE, FOLDED IN A ZIG-ZAG MANNER

[75] Inventor: Kurt Stemmler, Neuwied, Fed. Rep. of Germany

[73] Assignee: Winkler & Dünnebier Maschinenfabrik und Eisengiesserei GmbH & Co. KG, Neuwied, Fed. Rep. of Germany

[21] Appl. No.: 807,318

[22] Filed: Dec. 10, 1985

[30] Foreign Application Priority Data

Dec. 24, 1984 [DE] Fed. Rep. of Germany ..... 3447404

[51] Int. Cl.[4] ..... B26D 7/06

[52] U.S. Cl. ..... 83/94; 270/40; 493/346; 493/357; 493/430

[58] Field of Search ..... 83/94; 270/39, 40; 493/344–348, 356–360, 430, 433

[56] References Cited

U.S. PATENT DOCUMENTS 408,390 8/1889 Tucker ..... 493/360
1,561,907 11/1925 Cannard et al. ..... 270/39
1,695,421 12/1928 Gail ..... 493/359

FOREIGN PATENT DOCUMENTS 2853741 7/1980 Fed. Rep. of Germany ..... 493/359
535956 4/1922 France ..... 270/39

*Primary Examiner*—Paul A. Bell
*Assistant Examiner*—Eugenia A. Jones
*Attorney, Agent, or Firm*—Nies, Webner, Kurz & Bergert

[57] ABSTRACT

A plant for the production of stacks of intermeshed blanks of paper, cellulose or the like folded together in a zig-zag fashion, in which two supply rolls are associated with the plant. Material webs on the rolls correspond to a multiple of two, four, or six or a higher even-numbered multiple of the width of the individual blanks. Longitudinal cutting stations divide the material webs into partial webs. The partial webs are opposite each other and run toward each other in the longitudinal direction of the webs and are fed to a stack-producing unit from two opposing sides. The stack-producing units of partial webs adjacent to each other are arranged in displaced relation to each other.

5 Claims, 2 Drawing Figures

PLANT FOR PRODUCING STACKS OF INTERMESHED BLANKS OF PAPER, CELLULOSE OR THE LIKE, FOLDED IN A ZIG-ZAG MANNER

BACKGROUND OF THE INVENTION

This invention refers to a plant for producing stacks of intermeshed blanks of paper, cellulose or the like, which are folded in a zig-zag fashion, which plant consists of more than one stack-producing unit.

Up to now it has been known and customary to design plants of the type in question with two paths, i.e., two webs of material drawn from one supply roll each and guided one above the other are divided along their center line to form two double webs, in order to be subsequently fed to two adjacent stack-producing units of conventional construction. For technical-constructional reasons, it has not been possible up to now to provide plants of the type described above for more than two paths.

OBJECT OF THE INVENTION

The task of the invention is to provide a plant for producing stacks of intermeshed blanks of paper, cellulose or the like, which are folded in a zig-zag fashion, such that wider material webs drawn from supply rolls are separated into more than two parallel webs and are subsequently processed or handled in the manner known and customary per se, in order to more economically produce the stacks of intermeshed blanks folded in a zig-zag manner.

For the solution of the aforementioned task, the proposal according to the invention is to design the plant in question in such a way that two supply rolls, preferably one at each end, are associated with the plant, with the material webs of said rolls corresponding to 2, 4, 6 times or an even-numbered multiple of the width of the individual blanks of the stack; the stations for making longitudinal cuts separating the material webs into 2, 4, 6, etc. partial webs are connected at the output end of the two stations for unrolling the material webs; the partial webs opposite each other and running towards each other in their longitudinal direction are fed in each case to one stack-producing unit from two opposing sides; and the stack-producing units of adjacent partial webs are arranged in staggered relationship to each other.

In the plant designed according to the invention, it is advantageous for the stack-producing units of the first, third, fifth, etc. partial webs to be located adjoining the one unrolling station and the stack-producing units of the second, fourth, sixth, etc. partial webs to be located adjoining the other, opposite unrolling station and spaced apart from the former in the longitudinal direction of the web.

Furthermore, it is advantageous for the production units of the third and/or fourth partial webs to be arranged, in the longitudinal direction of the webs, in staggered relationship to the stack-producing units of the first and fifth and/or the second and sixth partial webs, respectively.

BRIEF DESCRIPTION OF THE DRAWINGS

FIG. 1 shows a side view of the plant and

FIG. 2 shows a plan view of the center part of the plant according to FIG. 1.

DETAILED DESCRIPTION OF THE DRAWINGS

Figure 1:
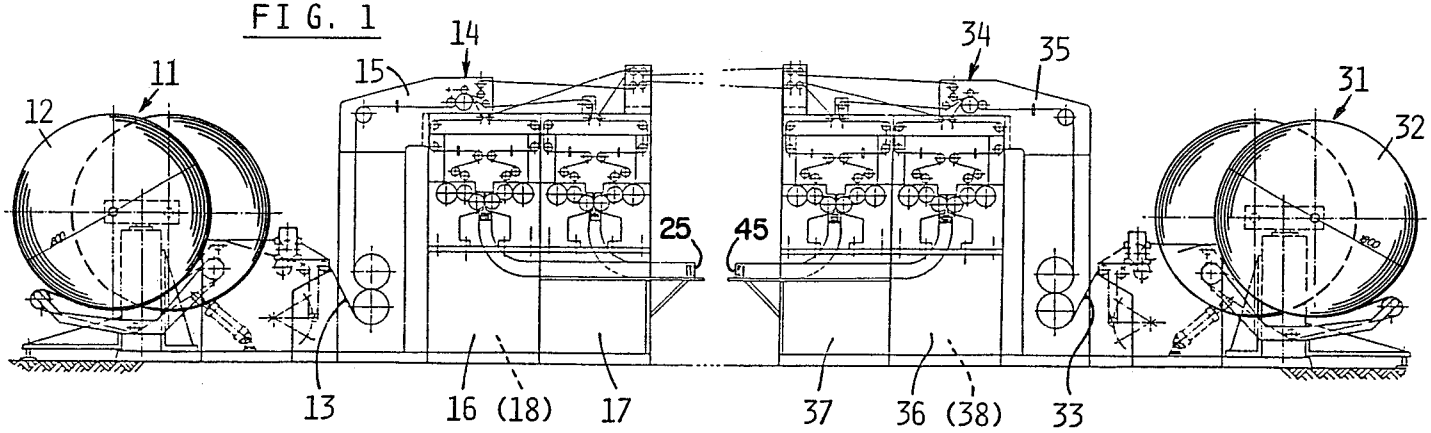
In FIGS. 1 and 2 of the drawings the plant for producing intermeshed blanks of paper, cellulose or the like, which are folded in zig-zag fashion according to the invention is shown on the basis of a preferred embodiment.

An unrolling station 11 is located at one end, the left-hand end in the drawing, of the plant, with the supply roll 12 from which the material web 13 is drawn being mounted therein, the material web then being fed to the station 14 for the longitudinal cut, which is mounted on a frame 15 above the stack-producing units 16, 17 and 18. The material web 13 is divided into six partial webs 19, 20, 21, 22, 23 and 24, as FIG. 2 shows in particular.

On the other, opposite side of the plant the unrolling station 31 is located, with the supply roll 32 from which the material web 33 is drawn being mounted therein, the material web then being fed to the station 34 for the longitudinal cut, which is mounted on a frame 35 above the stack-producing units 36, 37 and 38.

Figure 2:
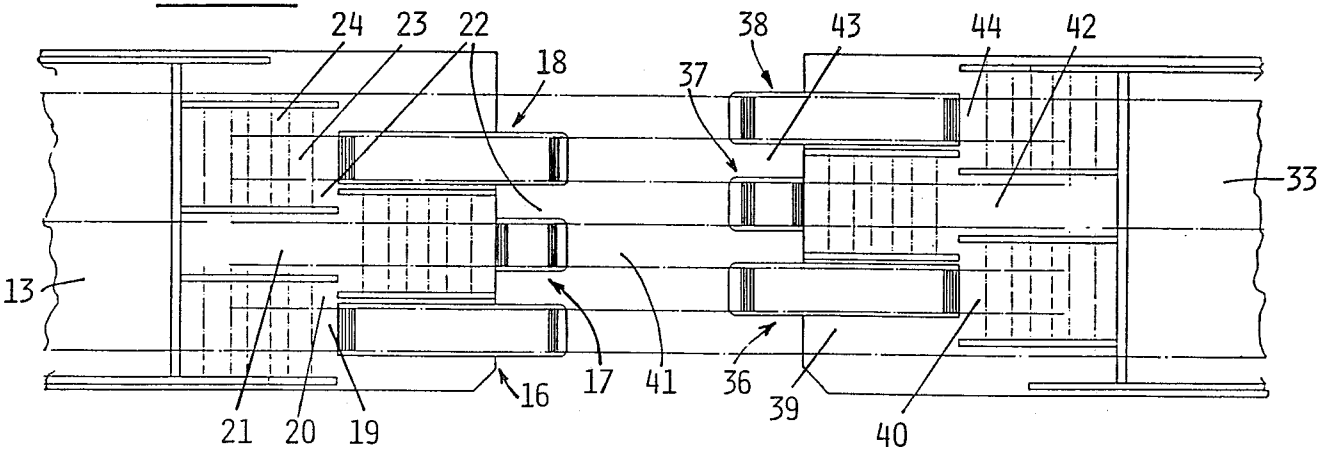

As shown in FIGS. 1 and 2, the plant consists of two parts, designed or assembled in symmetrical relationship to each other, but wherein the three stack-producing units of the one half are laterally displaced relative to those of the other half by the width of one partial web. Partial webs running together from opposite sides are fed to each stack-producing unit and are then further processed and handled in said unit, to form stacks 25 and 45 of intermeshed blanks folded in zig-zag fashion. Thus, for example, the partial web 19 coming from the left side and the partial web 39 coming from the right side are fed to the stack-producing unit 16 to form stack 25. The partial webs 20 and 40 adjacent to these two partial webs 19 and 39 are fed to the stack-producing unit 36 to form stack 45. The partial webs 21 and 41 are fed to the stack-producing unit 17, the partial webs 22 and 42 to unit 37, the partial webs 23 and 43 to unit 18 and the partial webs 24 and 44 to the unit 38. The stack-producing units 17 and 37 are displaced relative to the units 16 and 18 or 36 and 38 respectively, which in each case are arranged on the same lateral level transverse to the longitudinal direction of the plant.

By means of such an arrangement of the individual units of the plant it is possible to process more than two material webs at a time to form stacks 25, 45 of intermeshed blanks folded in a zig-zag manner.

I claim:

1. A plant for the production of stacks of intermeshed blanks of paper material made from cellulose or the like, folded together in a zig-zag fashion, consisting of more than one stack producing unit, comprising: two material web unrolling stations, each with a supply roll (12,32) of paper material webs, associated with and at opposite ends of the plant, each of the material webs (13,33) correspond in width to an even-numbered multiple of the width of the individual blanks of the stacks (25,45); and means are provided for feeding said material webs toward and aligned with each other; longitudinal cutting stations (14,34) for dividing each of said material webs (13,33) into an identical even numbered plurality of partial webs (19 to 24; 39 to 44) are provided and connected at the output side of said two material web unrolling stations (11,31); the resultant partial webs (19,39; 20,40; 21,41; 22,42; 23,43; 24,44) of each material web opposing each other and feeding toward each other in the longitudinal direction of the webs constitute pairs of partial webs; and means are provided for feeding each partial web, of each pair of partial webs, to an associated one of said stack producing units (16, 17, 18, 36, 37, 38) from two opposing sides of the associated stack producing units; and each of the stack producing units (16,36; 17,37; 18,38) for laterally adjacent pairs of partial webs (19,39; 20,40; 21,41; 22,42; 23,43; 24,44) are arranged in displaced relation to each other in the direction of the path between the two supply rolls permitting the adjacent partial webs to be juxtaposed in the lateral direction.

2. A plant according to claim 1, wherein a first group of said stack producing units (16, 17, 18) associated with, in a lateral sense, every other pair of aligned partial webs (19, 21, 23 or 39, 41, 43) are located adjoining a first of said unrolling stations, (11) and a second group of said stack producing units (36, 37, 38) associated with the intermediate pairs of aligned partial webs (20,40; 22,42; 24,44) between said every other pair are located adjoining the other, opposite, unrolling station (31) and spaced apart from said first group in the longitudinal direction of the web.

3. A plant according to claim 1, wherein the stack producing units (17,37) for every other pair of partial webs (21,41; 22,42) are displaced relative to each other in the longitudinal direction of the web.

4. A plant according to claim 2, wherein alternate ones of the stack producing units (17,37) in each of said groups of stack producing units are displaced relative to the other ones of the stack producing units in the same associated group in the longitudinal direction of the web.

5. A plant according to claim 1 wherein each of said two supply rolls (12,32) of material web (13,33) to be processed is rotatably mounted at an associated opposite end of said plant.

* * * * *